US006216684B1

(12) United States Patent
Champion

(10) Patent No.: US 6,216,684 B1
(45) Date of Patent: Apr. 17, 2001

(54) WOOD HEATER

(76) Inventor: Mark Champion, P.O. Box 10367, Blacksburg, VA (US) 24062

( * ) Notice: Subject to any disclaimer, the term of this patent is extended or adjusted under 35 U.S.C. 154(b) by 0 days.

(21) Appl. No.: 09/528,098

(22) Filed: Mar. 17, 2000

Related U.S. Application Data

(60) Provisional application No. 60/125,742, filed on Mar. 23, 1999.

(51) Int. Cl.[7] ..... F24C 1/14

(52) U.S. Cl. ..... 126/77; 126/85 B; 126/193; 126/523; 126/531

(58) Field of Search ..... 126/60, 77, 290, 126/65, 83, 540, 541, 512, 521, 531, 523, 200, 193, 527, 515, 528

(56) References Cited

U.S. PATENT DOCUMENTS

| | | | | |
|---|---|---|---|---|
| 3,400 | | 1/1844 | Cline . | |
| 20,667 | | 5/1858 | Savage . | |
| 22,642 | | 1/1859 | Granger . | |
| 58,477 | | 10/1866 | Resor . | |
| 63,885 | | 4/1867 | Harris et al. . | |
| 115,014 | | 5/1871 | Barclay . | |
| 394,702 | | 12/1888 | Keyser . | |
| 2,939,451 | * | 6/1960 | Emmons | 126/541 |
| 4,368,722 | | 1/1983 | Lynch . | |
| 4,465,055 | * | 8/1984 | Bortz | 126/521 |
| 4,643,165 | * | 2/1987 | Chamberlain | 126/77 |
| 5,603,312 | | 2/1997 | Champion et al. . | |
| 5,701,882 | * | 12/1997 | Champion | 126/77 |

* cited by examiner

*Primary Examiner*—James C. Yeung
(74) *Attorney, Agent, or Firm*—McGuireWoods LLP

(57) ABSTRACT

A combustion system for burning firewood including a combustion chamber defined by front, rear and side walls, a ceiling and a bottom. An access door is provided for addition of fuel into the combustion chamber. A substantial amount of combustion air enters the combustion chamber near the top of the fueling doors via apertures and is directed down the face of the fueling doors providing cooling. A geometry of the air metering orifice is either fixed or of limited adjustability such that the minimum flow of combustion air required for flaming combustion of a full load of fuel is maintained at all times. The combustion air flow cannot be reduced beyond a certain point and thus smoldering and very low air/fuel ratios are avoided. Since the air metering is tuned for proper flaming combustion with the largest expected fuel load and cannot be reduced further, fuel loads smaller than the design fuel load will result in higher air/fuel ratios, thus further ensuring that sufficient combustion air is present for sustained flaming. Furthermore, the minimum combustion air setting limits the amount of combustion air entering the combustion chamber such that too much air is not introduced resulting in inefficiency due to sensible heat loss, chemical loss (pollution), quenching of the flames, and undesirably high burn rates. Ideally, the burning rate of a full load of fuel is below 5 kg/hr, however, the maximum bum rate when burning a full load of fuel may be reduced to as low as 2 kg/hr depending on the size of the firebox and the desired maximum heating capacity of the appliance. Heat output is adjustable primarily by the amount of fuel added at each fuel loading.

29 Claims, 4 Drawing Sheets

WOOD HEATER

CROSS REFERENCE TO RELATED APPLICATIONS

This application claims the benefit of U.S. Provisional Application No. 60/125,742, filed Mar. 23, 1999.

BACKGROUND OF THE INVENTION

1. Field of the Invention

The present invention generally relates to a solid fuel combustion system with improved combustion and aesthetics and, more particularly, to a solid fuel combustion device with a limited travel air supply intended to, amongst other things, simplify operation and reduce emissions of air borne pollutants.

2. Background Description

In the mid 1980's growing concern over ambient air quality caused regulators to focus on wood burning appliances as sources of significant amounts of particulate matter and other pollutants which posed a threat to human health. Hardware commonly known as "wood heaters" were the subject of a federal new source performance standard in 1988. This standard required the certification of all new wood heaters sold in the United States and was intended to cover only those products which were capable of burning at low air/fuel mixtures, a condition which can lead to high emissions of particulate matter (PM), carbon monoxide (CO) and other organic pollutants.

Wood burning appliances falling within the Environmental Protection Agency (EPA) definition of a "wood heater" must be certified as clean burning by meeting specified emissions criteria when tested in a laboratory using standardized test methods. The standard specifically defines wood heaters based on performance characteristics, their intended use and size. Site built masonry fireplaces, cookstoves, boilers and central heaters, and masonry heaters were exempt from this federal regulation. Fireplaces are not automatically exempt from regulation but gain exemption through application of EPA Method 28A (see 40 C.F.R. §60 (1988)) which is a standardized test method determining minimum burn rate and air-to-fuel ratio. Using this test method, any device exhibiting an average bun rate of higher than 5 kg/hr or an air-to-fuel ratio of higher than 35 to 1 is determined not to be a wood heater and is therefore exempt from federal regulation.

The EPA Method 28A is accepted as a reference method for determining specific operational characteristics of a wood burning appliance. Procedures for determining the minimum burn rate and the average air-to-fuel ratio are specified. The following discussion makes reference to specific burn rates and air-to-fuel ratios and unless otherwise specified, EPA Method 28A is the reference method for determining the specified values. Similarly, the term "full load" in the following discussions refers to the fuel load specified by EPA Method 28A and is considered representative of the largest fuel load likely to be encountered with use of the wood heater.

Numerous studies of emissions from EPA certified wood burning stoves have shown that field performance can vary widely depending on, among other things, fuel quality, mechanical degradation and operator actions. Poor or unpredictable performance, in effect, circumvents the intent of mandating EPA certified wood heaters since emissions of pollutants are not controlled as desired. While the factors of fuel quality and mechanical degradation can be remedied, operator performance is very difficult to control. Proper operation of air controls and bypass dampers is critical to ensuring proper emissions reduction in current certified stove models and the factors of installation, fuel properties, heating needs and even weather will require different operation from day to day or from household to household. With these factors in mind the actions or inactions of the operator when using the stove controls can be critical to effective stove performance.

Further and more specifically, current technology wood stoves have operator controls which if used improperly can cause poor performance. Wood stoves may include catalytic converters or tuned secondary air systems which serve to reduce emissions by enhancing combustion efficiency or combusting the pollutants within the effluent stream prior to entering the chimney or venting system. These systems require operator knowledge as the stoves and/or catalytic combustors must be sufficiently heated in order to be effective in emissions reduction. In the case of catalytic stoves, actuation of a bypass diverts the flow of combustion products through the catalytic combustor. If the bypass damper does not get actuated or the catalyst itself is not sufficiently heated and the stove is banked soon after fuel loading, the catalyst might not get lit and no emissions reductions are achieved. Similarly, there is opportunity for non-catalytic stoves to be banked too soon, even when using proper fuel, since preheating of the secondary air system is necessary to combust volatile organic materials evolved from the wood. Once the stove is banked and the air-to-fuel ratio (mass of air divided by mass of fuel) is overly reduced in these devices, flaming may cease and the wood stove might enter a smoldering phase which can last for the entirety of a fuel charge. These scenarios are supported in the field data and are considered undesirable.

Further, with the continuing concern over wood smoke, some localities, particularly in the Western region of the United States have widened the scope of their regulations to restrict or ban residential solid fuel burning devices which are not federally regulated. These include what are commonly known as fireplaces and masonry heaters. While these devices have served a need and have been popular in homes for centuries, some local regulations allow only EPA certified devices to be installed. Since masonry heaters and fireplaces are not affected facilities under federal law, no means of certifying their performance exists and the devices cannot be installed, or in some cases even used, in these localities. EPA certified wood stoves using current technology emissions control systems attempt to fill the need of fireplace customers however, the expense of added operator controls, pollution reduction equipment and, in general, heavier airtight welded construction make the cost of these devices higher than is desirable. Also, the complexity of user controls is higher than it need be for primarily decorative appliances, possibly resulting in operator error and less than desirable performance.

Fireplaces typically have little if any combustion air control and are intended primarily as decorative devices, although some models can be used as supplemental heaters as well. Inefficiencies of fireplaces result from high fuel burning rates and high air-to-fuel ratios as compared to wood stoves which are primarily intended for heating. Combustion efficiency can be relatively good due to the abundance of air and the presence of flaming; however, too much air can have a quenching effect which inhibits efficient combustion. Even if the combustion efficiency is relatively high (as indicated by low pollutants per unit mass of fuel), the uncontrolled high fuel burning rate can result in high emission rates (mass of pollutant per unit time), which is the measure of emissions of primary concern to air pollution regulators.

Currently, a great variety of wood burning systems have been described and demonstrated in the prior art. Indeed, "fireplaces" and "woodstoves" have been in existence for hundreds of years but operationally, efficiency and pollution concerns still exist which are not adequately addressed with the current state of the art. Wood burning appliances may be classified as "open" or "closed" combustion devices. The term "open" refers to un-controlled; un-regulated or fuel-lean operation as in "fireplaces", while the term "closed" implies controlled, regulated or fuel rich combustion as in "woodstoves". Un-regulated wood burning systems have low heating efficiency due to high flow rates of combustion or cooling air while regulated systems exhibit low combustion efficiency as a result of operating in a fuel rich range which, in turn, results in incomplete combustion of the organic components of the fuel and higher emissions.

Prior art systems have sought to improve the performance of either controlled or uncontrolled devices in a wide variety of ways. In the case of fuel rich devices (wood stoves), a variety of pollution control technology intended to enhance combustion efficiency when a device is operating in a fuel rich condition have been described in the art. These include the use of complex secondary combustion air introduction systems as in U.S. Pat. No. 4,766,876 to Henry, et al. or the use of catalytic converters as in U.S. Pat. No. 4,330,503 to Allaire, et al.

Many examples of improvements to uncontrolled, lean-burning combustion chambers have also been used and described for over one hundred years. While combustion efficiency is quite good relative to fuel-rich devices, low overall efficiency can result if the high sensible heat loss resulting from high air flow and relatively high fuel burning rates is not recovered. Prior art systems describe several heat recovery system which have been successful to varying degrees. These include the use of heat transfer chambers, long and tortuous flow paths and thermal mass storage, just to name a few. However, the known prior art devices are not operable at an average fuel consumption rate below 5 kg/hr when tested using accepted industry standards and in fact, in many instances, are intended to operate at much higher burn rates. This results in less than desirable efficiency for the reasons stated above. Significant overall efficiency improvement is made by reducing the combustion air flow and consequent burn rate.

In further examples, U.S. Pat. No. 4,368,722 to Lynch describes a device which, among other things, seeks to maintain a combustion zone within a fuel charge by novel introduction of controlled amounts of combustion air. The flow path and geometry of this air introduction are intended to help produce a lean combustion "zone" whereby complete combustion can occur. However, as in all known prior art relating to fuel rich wood burning devices, the Lynch system includes an adjustable air introduction system for "providing exactly the amount of air desired for proper combustion", but the proper amount of air is not specified. In fact, the combustion air can be over-dampened since the inlet controlling damper may be closed enough to allow the system to operate in a fuel-rich, non-flaming condition. Considering the teachings of the Lynch system, a stove capable of being throttled too much is capable of non-flaming or smoldering combustion which would require a "clean-up" technology to handle the resultant emissions. If the clean-up technology is ineffective (do to inefficiency, degradation or improper use) no emissions reduction is achieved.

In U.S. Pat. No. 20,667 to Savage, a heat stove with air introduction is described as a "self-regulating" air supply. Savage, however, is related only to the specific means and geometry of air introduction, and the range of operation is not specified.

What is needed in the art is a wood burning heater which burns standard firewood and ensures proper emissions performance independent of operator actions and minimizes or eliminates the requirements of proper control actions to achieve reduced emissions. A further need is a simply operated wood burning heater which effectively reduces emissions of pollutants while providing the decorative function of a fireplace.

SUMMARY OF THE INVENTION

It is therefore an object of the present invention to provide a combustion system with improved emissions performance in field use.

It is yet another object of the present invention to provide a combustion system having an operational range between "open" and "closed" combustion devices where both efficiency and pollution concerns are mitigated.

A still further object of the present invention is to provide a combustion system having a a minimum combustion air setting which ensures flaming, non-smoldering combustion and the assurance of emissions performance regardless of operator actions.

It is another object of the present invention to provide a combustion system which eliminates the need for "clean-up".

A further object of the present invention is to provide a minimum combustion air setting which results in efficient and clean combustion regardless of the amount of fuel added to the firebox.

Still another object of the present invention is to provide a minimum air setting which provides the necessary air to maintain consistent flaming of the fuel within the firebox.

Yet another object of the invention is to provide a minimum air setting which limits the burn rate and air flow to provide a minimum burn rate of between approximately 2 kg/hr and 5 kg/hr and a minimum air-to-fuel ratio when burning the maximum fuel charge and only higher air-to-fuel ratios when burning less than a full fuel load.

Still yet another object of the present invention is to provide a much simplified combustion system which reduces emissions of pollutants over a range of heat outputs which are determined mainly by the amount of fuel added.

The present invention relates to an improvement in efficiency of a combustion chamber by reduction of air flow enabling a hotter fire chamber, a lower mass flow rate of combustion products and increased residence time of combustion products and heated air within the combustion chamber and chimney. In order to accomplish the objectives of the present invention, the combustion system of the present invention comprises a combustion chamber defined by front, rear and side walls, a ceiling and a bottom. An access door is provided for addition of fuel into the combustion chamber, and in the closed position is substantially sealed with a suitable gasket material such that a minimum of air flows between the door frame and its mounting surface during operation. The fueling door preferably incorporates transparent glass, providing for viewing of the flames, however, the fueling door may also be formed of any suitable material such as steel or cast iron or the like. A vent or flue is located in the ceiling of the combustion chamber for exhausting of the products of combustion into a suitable chimney and to the outdoors.

A substantial amount of draft induced combustion air enters the combustion chamber near the top of the fueling doors and is directed down the face of the fueling doors providing cooling. A general downward then rearward sweeping of the combustion air as it moves towards the fuel is also generated. A geometry of the air metering orifice is either fixed or of limited adjustability such that the minimum flow of combustion air required for flaming combustion of a full load of fuel is maintained at all times. The combustion air flow cannot be reduced beyond a certain point and thus smoldering and very low air/fuel ratios are avoided. Since the air metering is tuned for proper flaming combustion with the largest expected fuel load and cannot be reduced further, fuel loads smaller than the design fuel load will result in higher air/fuel ratios, thus further ensuring that sufficient combustion air is present for sustained flaming.

Furthermore, the minimum combustion air setting limits the amount of combustion air entering the combustion chamber such that too much air is not introduced resulting in inefficiency due to sensible heat loss, chemical loss (pollution), quenching of the flames, and undesirably high bun rates. Ideally, at the minimum combustion air setting the maximum burning rate of a full load of fuel is below 5 kg/hr, however, the maximum burn rate when burning a full load of fuel may be reduced to as low as 2 kg/hr depending on the size of the firebox and the desired maximum heating capacity of the appliance.

Heat output is adjustable primarily by the amount of fuel added at each fuel loading. Fuel piece size, quality and frequency of addition of fuel will also provide more or less flaming at the discretion of the operator. However, since the minimum air setting ensures that the minimum acceptable air-to-fuel ratio will be maintained, the operator can take no action resulting in an undesirable fuel rich condition.

The construction of this combustion chamber need not be air tight as with conventional wood stove designs which are intended to operate at very low burn rates (less than 1 kg/hr). Since the minimum burn rate is relatively high with the current invention, leakage into the combustion chamber may be acceptable and considered simply a portion of the combustion air flow. (i.e. air leakage into the combustion chamber is considered part of the combustion air delivery system). Therefore, an added advantage of the combustion chamber of the current invention is that it may be constructed of generally lighter gage material using common fasteners, thus reducing weight, manufacturing costs.

BRIEF DESCRIPTION OF THE DRAWINGS

The above-mentioned and other features, aspects and advantages of the present invention will be better understood from the following detailed description of a preferred embodiment of the invention in conjunction with the drawings, in which.

DETAILED DESCRIPTION OF A PREFERRED EMBODIMENT OF THE INVENTION

For illustrative purposes only a wood heater is described herein. It will be well appreciated that the description herein is of but one preferred embodiment of the invention and is not to be construed as limiting the scope of the invention in any manner. Furthermore, the invention described here is considered a base technology which can be implemented in a variety of applications and the illustrated embodiment should not be construed as limiting the scope of further applications of the combustion system such as a coal burning system and the like.

The Combustion Chamber

Figure 1:
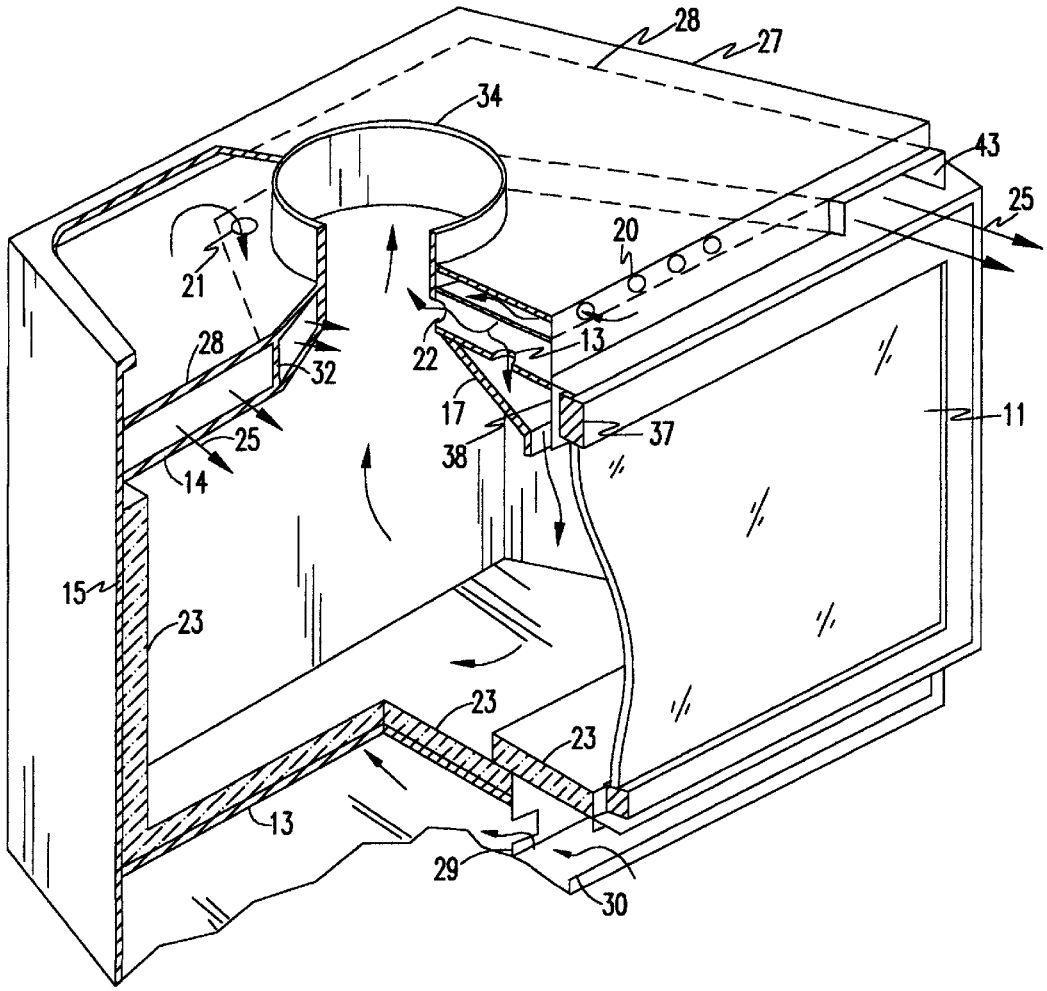
FIG. 1 is a cut away perspective view of the combustion system of the present invention.
Figure 2:
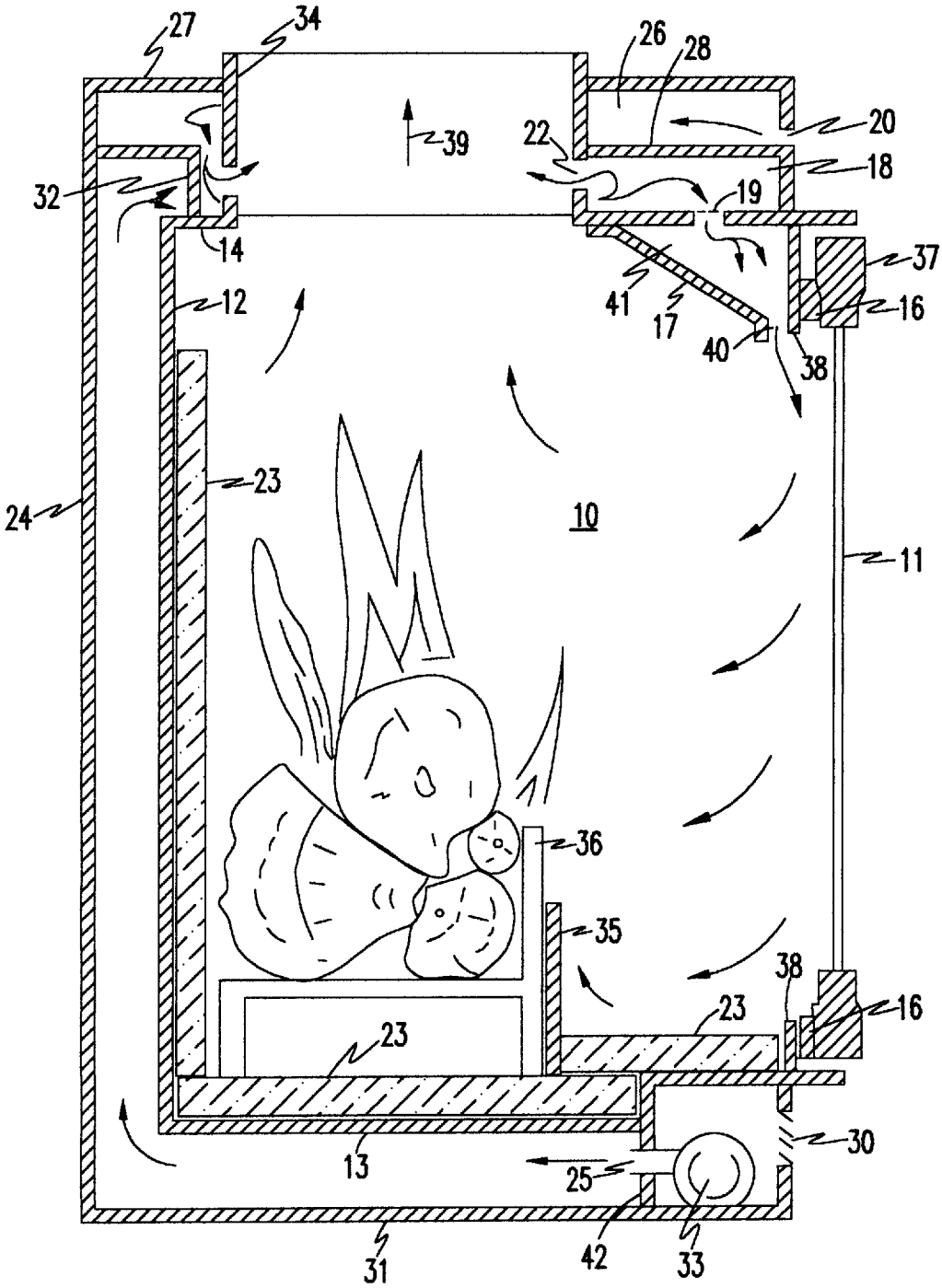
FIG. 2 is a side sectional view of the combustion system of the present invention.

Referring now to the drawings, and more particularly to FIGS. 1 and 2, there are shown a perspective cut away view and a side sectional view of the combustion system of the present invention. In the preferred embodiment, a combustion chamber 10 is defined by vertical front wall 38, rear wall 12 and side walls 15. The bottom and top of the combustion chamber are defined by horizontal panels 13 and 14,respectively. In the embodiment shown in FIGS. 1 and 2, a door frame 37 enclosing transparent window 11 is hingedly attached to front wall 38 thus allowing access to the combustion chamber for fuel loading. Gasket 16 located between door frame 37 and front wall 38 forms a seal therebetween which inhibits flow of air from the living space into the combustion chamber 10 when the doors of the combustion chamber 10 are in the closed position.

The bottom side horizontal wall 13 and rear wall 12 are lined with refractory panels 23 which serve as a heat retention medium and as decorative components to the combustion chamber 10 interior. A refractory or ceramic ceiling liner is also contemplated for use with the combustion chamber of the present invention, and which provides a radiative barrier that protects the roof(e.g., horizontal panel 14) of the combustion chamber 10 from excessive heat. A fuel retaining grate 36 defines the fuel placement area which is disposed between the side and rear refractory panels 23 and, in the front, by the vertical fuel retaining standards which are integral with the fuel retaining grate 36. Flue collar 34 is provided at the horizontal panel 14 of the combustion chamber and forms a passageway for venting of the by-products of combustion depicted by arrow 39.

Combustion Air Flow

Combustion air enters apertures 20 which are fluidly connected to a source of uninhibited fresh air, which can be the space to be heated by the combustion system or through adequate ducting to outside ambient air, or both. Combustion air flows through space 26 which is defined by horizontal panels 27 and 28, and side walls 15. This space 26 provides both cooling to upper horizontal panel 27 and initial preheating of the combustion air flowing therein. The combustion air then flows around flue collar 34, continuing sideward and rearward and finally entering aperture 21 located in horizontal panel 28 at the rear side of the flue collar 34. An intermediate plenum 18 defined at top and bottom by horizontal panels 28 and 14, respectively, and at the sides by flue collar 34 and vertical divider 32 is also provided. The intermediate plenum 18 provides further preheating of the flowing combustion air. The flow of air must again travel around flue collar 34 and then frontward.

The intermediate plenum 18 supplies preheated combustion air to two sets of apertures, each set having a different purpose. The bottom of the intermediate plenum 18 is formed by horizontal panel 14 and includes several front combustion air apertures 19 which are in fluid communication with yet another chamber 41 formed between horizontal panel 14 and diagonally mounted panel 17. These front combustion air apertures 19 supply primary air to the combustion chamber 10 and are the primary means of metering air into the combustion chamber 10. Preferably the front combustion air apertures 19 in horizontal panel 14 are of fixed geometry and are sized to limit the amount of air flow such that when burning a full load of fuel, the resulting fuel consumption rate is below 5 kg/hr but not below 2 kg/hr when measured using EPA Method 28A (see 40 C.F.R. §60 (1988)), which is incorporated by reference in its entirety in the present application. In general, EPA Method 28A (see 40 C.F.R. §60 (1988)) includes measurement of the time averaged mass burn rate during the full consumption of a single fuel load burned while the combustion air control is in its most restrictive position. The fuel load consists of several pieces of nominally 2"×4" or 4"×4" (or a mix of these) Douglas fir construction grade lumber at a moisture content of between 19 and 25% (dry basis). The mass of the fuel load (all 2"×4" or 4"×4" pieces combined) is nominally 7 pounds per cubic foot of useable firebox volume, but may be anywhere between 6.3 and 7.7 pounds per cubic foot. Individual fuel pieces are spaced evenly at nominally 1" to 2" apart and placed on a pre-existing coalbed at the beginning of the test. However, front combustion air apertures 19 may be of adjustable geometry with the minimum adjustable flow area resulting in a burn rate of between 2 kg/hr and 5 kg/hr, thus the lowest air setting of front combustion air apertures 19 results in a "high efficiency" mode of operation.

The sizing of front combustion air apertures 19 in order to achieve the burn rate goal is dependent on a number of factors including, but not limited to, the volume of the combustion chamber 10, the size and location of the flue collar 34, and other fluid flow restrictions within the combustion air flow path. The front combustion air apertures 19 must also be of sufficient flow area to provide enough primary air to the combustion chamber 10 so that, on average, a fuel rich condition does not occur in the combustion chamber 10 when burning a full load of fuel, and thus continuous flaming of the fuel is maintained.

Air chamber 41, in fluid communication with intermediate plenum 18 via front combustion air apertures 19, supplies all primary combustion air to combustion chamber 10. Aperture 40 is formed by the horizontal gap between panel 38 and diagonally mounted panel 17, and extends the width of the combustion chamber 10 as defined by side walls 15. Combustion air is introduced to the combustion chamber 10 along the entirety of the top edge of the loading door, in part to create a downward air wash intended to maintain the clean appearance of the transparent panel 11.

The flow of combustion air leaving aperture 40 is cool relative to the flaming gases within combustion chamber 10 and therefore, due to its density, travels downward along the glass toward the floor of the combustion chamber 10. The natural draft of the fire then pulls the air rearward and upward toward the flaming fuel and then out of the combustion chamber 10 through flue collar 34. Panel 35 is disposed in front of fuel burning grate 36 and effectively blocks the direct flow of fresh combustion air from flowing beneath the grate 36, a condition which can lead to an over-accelerated fire and fuel rich conditions within the pile of combusting solid fuel, particularly when burning a large mass of fuel.

In the preferred embodiment, apertures 22 are formed around the circumference of flue collar 34 and are in fluid communication with intermediate plenum 18. These apertures 22 supply secondary air directly to the exiting flow of combustion gases 39. It will be appreciated by one of ordinary skill in the art that this secondary air flow is not necessarily derived from apertures 22 formed in flue collar 34, but could be supplied at the upper portion of the combustion chamber 10 by any suitable means such as another plenum, air delivery tubes and the like, provided that the flow of secondary air does not flow into combustion chamber 10 but rather mixes with the effluent of combustion chamber 10. The preferred embodiment shown herein simply represents a convenient method of introducing preheated secondary combustion air. The flow of air through apertures 22 is proportional to the draft created by the venting system (e.g., products leaving the combustion chamber 10 via the flue collar 34), and thus when larger fires are present and secondary air is needed for complete combustion, the flow of air through apertures 22 is increased. This is helpful when burning full fuel loads as these loads result in the largest fires, and particularly with higher volume combustion chambers which accommodate larger fuel loads.

Design Parameters for Efficient and Clean Combustion

Referring to the combustion system described thus far, it will be appreciated that tuning of the combustion air system in conjunction with the combustion chamber volume and specific venting will be important to ensuring efficient and clean combustion. Further, in more preferred embodiments, specific design parameters are required to ensure efficient and clean combustion over the range of fuel charge masses which will be encountered in normal use of the wood heater. It will be further described herein how the combustion system of the present invention, and more specifically the combustion air system, is designed to accommodate a wide range of fuel load sizes.

Both the air-to-fuel ratio and the fuel burning rate must be considered when tuning the combustion air system. Overly high fuel burning rates and high air-to-fuel ratios both imply higher than necessary effluent mass flow from the combustion system, and thus higher pollutant flow rates, the parameter of concern when considering emissions of pollutants to the atmosphere. Further, the air-to-fuel ratio being too low (below about 6 to 1 for wood) leads to incomplete combustion and emissions of unburned organic materials and combustible gases.

For this reason, the air-to-fuel ratio is of primary concern and when burning a full load of fuel, the condition most likely to result in low air-to-fuel ratios, the minimum combined air flow through apertures 19 and 22 needs to be high enough to ensure continuous flaming and an average air-to-fuel ratio of between 8 to 1 and 35 to 1 but preferably about 12 to 1. At the preferred burn rate and the preferred air-to-fuel ration, the combustion air flow rate is substantially 23 scfm, and the minimum flow rate at the preferred burn rate and the minimum air-to-flow ration is substantially 16 scfm.

If at the same time the minimum amount of combustion air entering the combustion chamber 10 is low enough to ensure a fuel burning rate of between 2 kg/hr and 5 kg/hr, but preferably about 4 kg/hr, the pollutant emission rate is further minimized, preferably a particulate matter emission rate of approximately below 7.5 kg/hr. Singly or combined, the combustion rate control and the air-to-fuel ratio control ensure that the mass flow rate of combustion products leaving the chimney is very low compared to uncontrolled solid fuel combustion devices and thus the emission rate of any pollutants not combusted will be lowered. When the combined aperture area of apertures 19 and 22 meets these design criteria, no further reduction of air flow into the combustion chamber 10 and flue collar 34 is possible and thus an operator cannot reduce the air setting further, which would result in possible ceasing of flaming and air starved conditions below about an 8 to 1 air to fuel ratio.

It will be appreciated that front combustion air apertures 19 will be sized such that the desired maximum average fuel burning rate, and thus the maximum heat output, is maintained when burning a full load of fuel. Apertures 22 are then sized to produce the proper air-to-fuel ratio. The desired burn rate range is 2 to 5 kg/hr but 4 kg/hr is preferred. The proper air-to-fuel ratio range is between 8 to 1 and 35 to 1 but 12 to 1 is preferred when burning a full load of fuel. Thus, the r ange of combined air flow through apertures 19 and 22 must follow the following example, where average combined air flows are given in cubic feet per minute at standard atmosp heric pressure (14.7 psia) and temperature (68 deg F):

| | | Air-to-Fuel Ratio | | |
|---|---|---|---|---|
| | | 8 to 1 | 12 to 1 (preferred) | 35 to 1 |
| Average Burn Rate (kg hr) | 5 | 20 | 29 | 85 |
| | 4 (preferred) | 16 | 23 | 68 |
| | 2 | 7.8 | 12 | 34 |

Proper combustion of small amounts of fuel placed in the combustion chamber 10 is also a condition of concern. The fuel combustion rate can be much lower when burning small fuel loads, and the air-to-fuel ratio can become too high, primarily because less fuel is combusting, and q u enching of the flames as well as u ndesirable turbulence can result. Apertures 22 in the flue collar, having been sized for proper air-to-fuel ratio when burning full loads of fuiel, do not add air to the combustion chamber 10, and when burning smaller loads of fuel, do not contribute to higher air-to-fuel ratios in the combustion chamber 10. Thus, apertures 22 add air to the effluent and enhance combustion downstream of the combustion chamber during high combustion rate periods, but this same flow of air does not degrade the combustion efficiency at low burning rates and more efficient combustion can take place within the combustion chamber. Further, a wider range of fuel burning rates may be accommodated by the combustion system if numerous sets of secondary air apertures are located successively downstream of combustion chamber 10, for instance, in an elongated flue collar 34 where sets of aperture 22 are located at several elevations and thereby staging the introduction of secondary air without inhibiting combustion efficiency up stream.

The fuel burning rate and emissions are further controlled by panel 35 which effectively blocks the flow of fresh combustion air under fuel grate 36. The fuel is placed on fuel burning grate precisely because some under-fire air is necessary to promote good combustion, however, too much under-fire air results in local fuel rich conditions within the burning mass of fuel and uncontrolled bum rates during the combustion of both large and small fuel loads. In the described embodiment, a fuel grate 36 is elevated above the combustion chamber floor 23. However, it will be appreciated that the fuel grate 36 could as well be recessed into the floor or the flow of air otherwise diverted such that fresh combustion air could not flow under the burning fuel charge. In this way, panel 35 would not be necessary. Furthermore, in the embodiments of the present invention, the fuel burning grate 36 as well as the combustion chamber floor could be slanted toward the front or back of the fireplace to affect a rolling of fuel pieces and charcoal toward the front or rear of the firebox, thereby concentrating the fuel load and heat as the fuel burns down and further enhancing flaming combustion.

Automatic Combustion Air Control

A further enhancement to the preferred embodiment is contemplated in the form of a combustion air control mechanism which may be operated manually or in another embodiment, automatically. As previously discussed, the primary air introduced through the series of apertures 19 may be variable by adjustment of the geometry or flow area of apertures 19, thus allowing a wider range of combustion air flows into the combustion chamber. The most restrictive air setting allows the minimum combustion air necessary to maintain a burn rate of between 2 and 5 kg/hr and a higher air flow setting is available for convenience of the operator. The higher air settings allow faster kindling and increased combustion air flow which is helpful if fuel quality is low (i.e. high moisture content or poor flaming characteristics).

Figure 3:
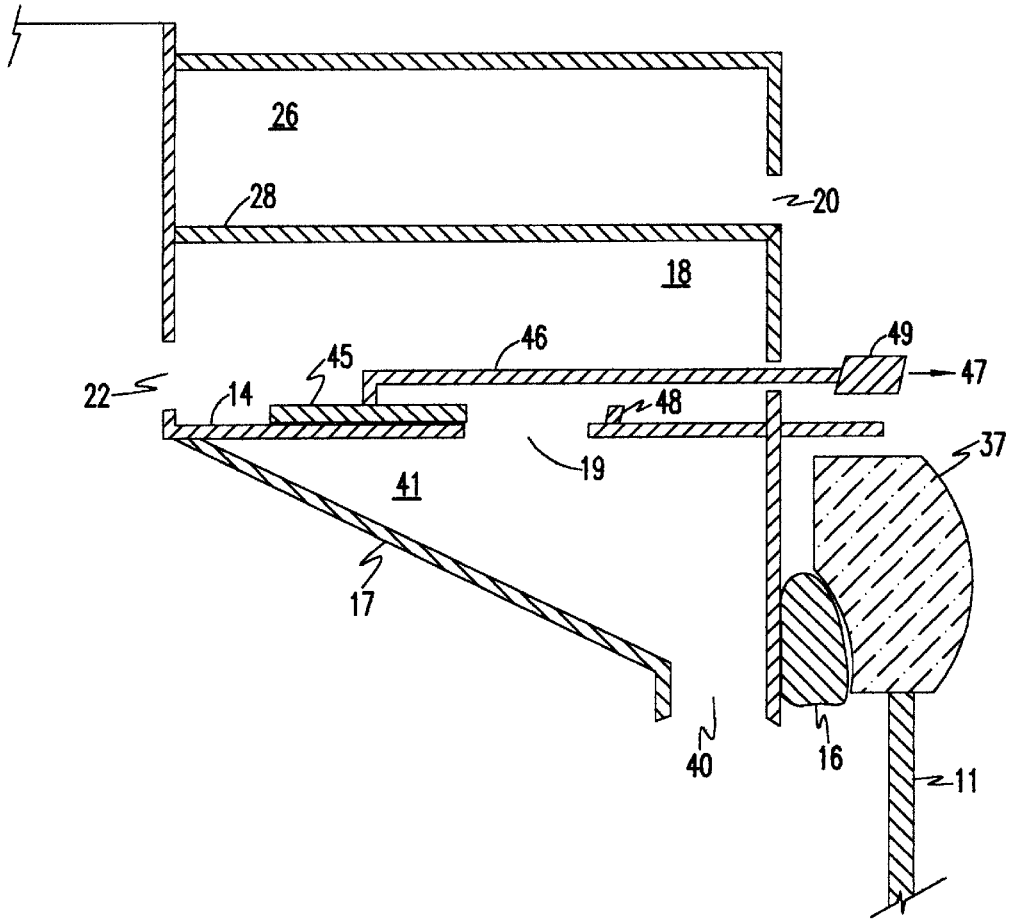
FIG. 3 is a sectional view of a combustion air control system used in the present invention.

Realizing now that higher air settings are useful when the combustion system is relatively cool (during start-up or if fuel quality is low), an air adjustment system improves performance. Referring to FIG. 3, the manually operated air adjustment system includes a sliding plate 45 and actuating arm 46 with handle 49 attached. When actuating arm 46 is manually moved outward in the direction of arrow 47, sliding plate 45 is moved horizontally against stop 48 which is rigidly attached to horizontal panel 14, thereby covering and blocking the flow of combustion air through at least one of the series of air flow apertures 19. Thus a portion of the combustion air flow is reduced.

Figure 4:
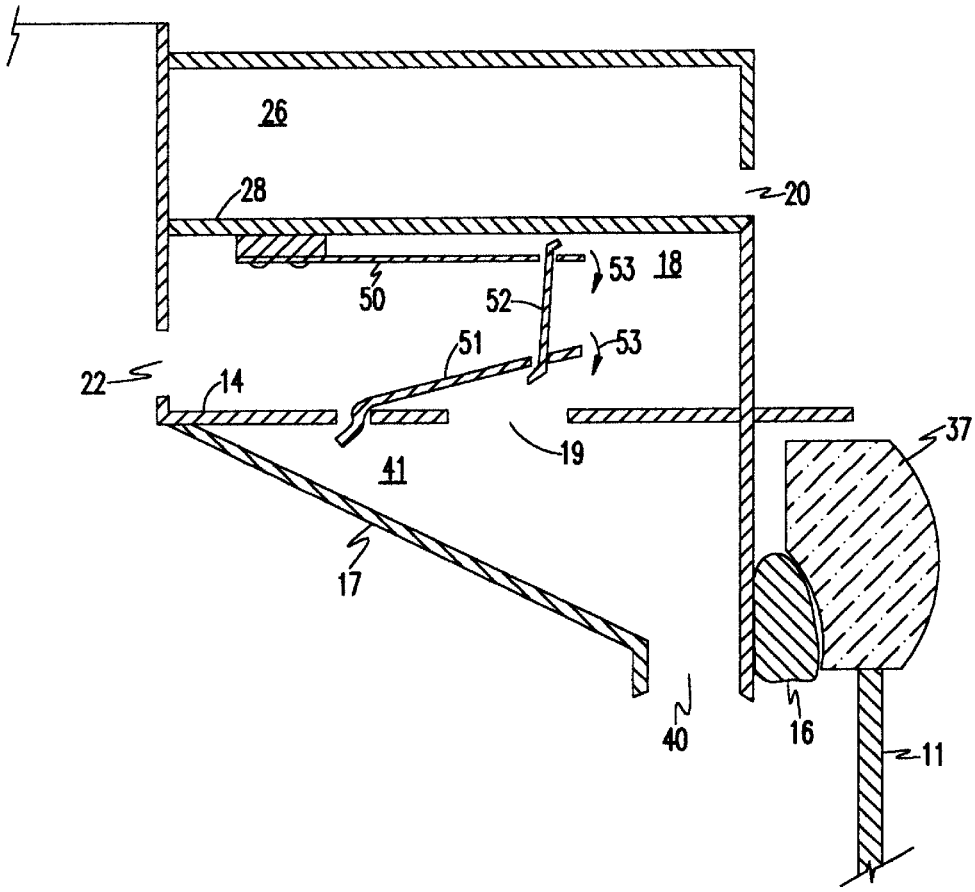
FIG. 4 is a sectional view of an automatic combustion air control system used in the present invention.

A further improvement to the preferred embodiment is in the form of an automatic combustion air adjustment system. When the combustion system is cold, a temperature sensing device such as a bimetallic coil or strip (known to those of ordinary skill in the art), through any suitable linkage, positions the adjustable combustion air inlet to its least restrictive position. As the combustion system heats up, the combustion air flow is gradually reduced in response to the temperature sensing element until the most restrictive air setting is reached. Thus, air adjustment is automatic, ensuring expedient kindling and heat-up and additional air as necessary depending on fuel conditions. Referring now to FIG. 4, one embodiment of an automatic air adjustment system used in the current invention is shown. Temperature sensing element 50 is a bimetallic strip rigidly mounted to horizontal panel 28 such that it bends downward in the direction of arrow 53 in response to a temperature rise. Sensing element 50 is linked to hingedly mounted plate 51 by linkage 52 and thereby moves plate 51 in response to sensed temperature changes. At a predetermined temperature, plate 51 is moved to generally a parallel position relative to horizontal plate 14 and thereby covers and blocks the flow of combustion air through at least one of the series of air flow apertures 19. Thus, a portion of the combustion air flow is automatically reduced in response to a sensed predetermined temperature.

It will be appreciated that such an air metering system, either manually or automatically actuated, may be comprised of many combinations of metering devices (valves, sliding plates, rotating dampers, etc.) in combination with actuators (mechanical or electrical) and temperature sensing devices (mechanical or electrical).

Heat Circulation

A heat exchange and air circulating system is incorporated into the present invention and is described herein. In this circulating system of the present invention, air from the space to be heated is drawn into a lower portion of the wood heater system, circulated up and around the back of the combustion chamber and then is ducted to the front and back into the living space. Referring to FIGS. 1 and 2, opening 30 beneath the fuel loading doors 11 freely communicates with the living space to be heated. A forced air blower 33 located behind opening 30 forces air through opening 29 which is formed in vertical support 42. A space defined by combustion chamber bottom (e.g., horizontal panel 13) and wood heater base 31 and side walls 15 ducts the air rearward to an upward passing space defined by rear wall 24, combustion chamber rear wall 12, and side walls 15. Being heated, circulating air rises toward horizontal panel 28 and is diverted in two directions passing parallel and in the same horizontal plane as intermediate plenum 18. Two ducts are formed just above and in contact with combustion chamber ceiling 14, and are defined at the top by panel 28, at the bottom by horizontal panel 14 and at the sides by side walls 15 and vertical member 32. Heated air then passes back into the living space through two openings 43 as indicated by arrow 25.

While the invention has been described in terms of a single preferred embodiment, those skilled in the art will recognize that the invention can be practiced with modification within the spirit and scope of the appended claims.

Having thus described our invention, what we claim as new and desire to secure by Letters Patent is as follows:

1. A solid fuel burning system for burning fuel, comprising:

a combustion chamber having a bottom wall, a top wall and four side walls forming an enclosure;

fixed geometry air supply means for providing a predetermined amount of combustion air to the burning fuel within the combustion chamber resulting in a maximum average burn rate of less than 5 dry kg/hr measured as a time averaged mass burn rate during a full consumption of a single filel load consisting of any combination of cut lengths of 2"×4" or 4"×4" dimensional lumber at a dry basis moisture content of between 19 and 25%, individual fuel pieces spaced between 1" and 2" apart, at a loading density of between 6.3 and 7.7 wet pounds per cubic foot of combustion chamber volume and placed on a coalbed having a mass between 20% and 25% of the wet fuel load mass; and a flue connected to the combustion chamber disposed in fluid communication with the combustion chamber wherein combustion products are vented from the combustion chamber.

2. The combustion system of claim 1, further comprising at least one openable access door one at least one of the side walls.

3. The combustion system of claim 2, wherein the at least one openable access door is transparent allowing a view of the burning fuel within the combustion chamber.

4. The combustion system of claim 1, wherein the fixed geometry air supply means provides the predetermined amount of combustion air to the burning fuel within the combustion chamber resulting in an average burn rate between 2 and 5 dry kg/hr.

5. The combustion system of claim 4, wherein the fixed geometry air supply means limits a time averaged flow of combustion air to between 8 and 85 standard cubic feet per minute and between an air-to-Fuel ratio of between 8 to 1 and 35 to 1, respectively.

6. The combustion system of claim 4, further comprising a secondary combustion air flow means for introduction of secondary combustion or cooling air to effluent of the combustion chamber as or after the effluent leaves the combustion chamber.

7. The combustion system of claim 6, wherein the fixed geometry air supply means and the secondary combustion air flow means together limit a time averaged flow of air to the combustion chamber and flue to a total of between 8 and 85 standard cubic feet per minute and between an air to fuel ratio of between 8 to 1 and 35 to 1, respectively.

8. The combustion system of claim 6, wherein the secondary air supply means is comprised of a preheating means for heating the secondary air prior to introduction to combustion chamber effluent.

9. The combustion system of claim 8, wherein the preheating means is formed by a plenum disposed substantially above the combustion chamber and in fluid communication with and intermediate to a source of fresh combustion air and the combustion chamber, an interior of the flue or both.

10. The combustion system of claim 1, further comprising preheating means for preheating the combustion air prior to entering the combustion chamber.

11. The combustion system of claim 1, wherein the fixed geometry air supply means is sized proportionally to the combustion chamber and fluid flow restrictions with a combustion air flow path, and is further positioned at a predetermined location with relation to the flue collar in order to provide the maximum average burn rate of less than 5 dry kg/hr.

12. The combustion system of claim 11, wherein the fixed geometry air supply means is further sized to ensure continuous flaming of the burning fuel.

13. The combustion system of claim 1, further comprising a blocking means for blocking a certain amount of the predetermined amount of combustion air from flowing under the burning fuel.

14. A solid fuel burning system for burning fuel, comprising:

a combustion chamber defined by a bottom wall, a top wall and four side walls;

adjustable combustion air metering means for limiting the amount of combustion air entering the combustion chamber;

a flue connected to the combustion chamber disposed in fluid communication with the combustion chamber wherein combustion products are vented from the chamber;

actuating means for adjusting the adjustable combustion air metering means resulting in a minimum average burn rate of between 2 and 5 dry kg/hr measured as the time averaged mass burn rate during the full consumption of a single fuel load consisting of any combination of cut lengths of 2"×4" or 4"×4" dimensional lumber at a dry basis moisture content of between 19 and 25%, spaced evenly and at a loading density of between 6.3 and 7.7 wet pounds per cubic foot of combustion chamber volume when the combustion air metering means is adjusted to a minimum air flow position.

15. The combustion system of claim 14, further comprising at least one openable access door on at least one of the side walls, the at least openable access door being transparent.

16. The combustion system of claim 14, wherein the adjustable combustion air metering means supplies a minimum time averaged flow rate of combustion air of between 8 and 85 standard cubic feet per minute when adjusted to a restrictive air flow setting.

17. The combustion system of claim 14, wherein the actuating means comprises:

a temperature sensing means for sensing the temperature in, on or near the combustion chamber, and a linkage means for adjusting the adjustable combustion air metering means in response to temperature changes sensed by the temperature sensing means.

18. The combustion system of claim 14, further comprising a secondary combustion air flow means for introduction of secondary combustion or cooling air to the effluent of the combustion chamber as or after the effluent leaves the combustion chamber.

19. The combustion system of claim 18, wherein the adjustable combustion air metering means and the secondary combustion air flow means supply a time averaged flow rate of air to the combustion chamber and flue to a total of between 8 and 85 standard cubic feet per minute when the combustion air metering means is adjusted to a restrictive air flow setting.

20. The combustion system of claim 18, wherein the secondary air supply means is comprised of a preheating means for heating the secondary air prior to introduction to the combustion chamber.

21. The combustion system of claim 20, wherein the preheating means is formed partly by a plenum disposed substantially above the combustion chamber and in fluid communication with and intermediate to a source of fresh combustion air and the combustion chamber, an interior of the flue or both.

22. The combustion system of claim 14, further comprising preheating means for preheating the combustion air prior to entering the combustion chamnber.

23. A combustion chamber, comprising:

a combustion chamber defined by a front and rear walls, side walls and top and bottom panels;

a flue collar in fluid communication with the combustion chamber such that combustion products are vented from the combustion chamber;

an upper chamber surrounding the flue collar and positioned above the top panel, the upper chamber having air entry apertures in fluid communication with primary fresh air used as combustion air;

an intermediate chamber in fluid communication with the upper chamber, the combustion air flowing from the upper chamber to a lower chamber, the intermediate chamber including combustion air apertures which meter the combustion air into the combustion chamber;

a lower air chamber in fluid conmnunication with the combustion air apertures of the intermediate chamber, the combustion air flowing through the lower air chamber prior to being metered into the combustion chamber; and secondary apertures formed around a circumference of the flue collar and in fluid communication with the intermediate chamber, the secondary apertures supplying secondary air directly to exiting flow of combustion gases from the combustion chamber.

24. The combustion chamber of claim 23, further comprising at least one door on one of the side walls, the at least one door being sealed to prevent air from entering the combustion chamber when the at least one door is in a closed position.

25. The combustion chamber of claim 23, further comprising a blocking means for blocking the combustion air from flowing under the burning fuel.

26. The combustion chamber of claim 23, wherein the upper chamber provides both cooling to an upper horizontal panel of the upper chamber and initial preheating of the combustion air.

27. The combustion chamber of claim 26, wherein the intermediate chamber provides preheating of the combustion air.

28. The combustion chamber of claim 23, wherein the lower air chamber is formed by a diagonally mounted panel extending from a lower surface of the intermediate chamber.

29. The combustion chamber of claim 28, further comprising at least one door on one of the side walls, the at least one door being sealed to prevent air from entering the combustion chamber when the at least one door is in a closed position, wherein the lower air chamber includes an aperture formed by a horizontal gap between the diagonally mounted panel and the side walls, and extends the width of the combustion chamber as defined by the side walls, and the combustion air is introduced to the combustion chamber along an entirety of the top edge of the at least one of the doors to create a downward air wash to maintain a clean appearance of the at least one of the doors.

* * * * *